US009998820B2

(12) United States Patent
Bearden

(10) Patent No.: US 9,998,820 B2
(45) Date of Patent: Jun. 12, 2018

(54) ACOUSTIC RESONATOR FOR AUDIO HEADPHONES

(71) Applicant: Donald Pierce Bearden, Little Rock, AR (US)

(72) Inventor: Donald Pierce Bearden, Little Rock, AR (US)

(73) Assignee: Donald Pierce Bearden, Little Rock, AR (US)

( * ) Notice: Subject to any disclaimer, the term of this patent is extended or adjusted under 35 U.S.C. 154(b) by 381 days.

(21) Appl. No.: 15/001,170

(22) Filed: Jan. 19, 2016

(65) Prior Publication Data

US 2017/0208387 A1 Jul. 20, 2017

(51) Int. Cl.
*H04R 1/28* (2006.01)
*H04R 5/04* (2006.01)
*H04R 1/10* (2006.01)

(52) U.S. Cl.
CPC ..... *H04R 1/2819* (2013.01); *H04R 1/1066* (2013.01); *H04R 5/04* (2013.01); *H04R 2400/03* (2013.01)

(58) Field of Classification Search
CPC ..... H04R 1/2819
USPC ..... 381/349
See application file for complete search history.

(56) References Cited

U.S. PATENT DOCUMENTS 3,814,864 A * 6/1974 Victoreen ..... H04R 7/24 381/174
4,860,368 A * 8/1989 Payer ..... H04R 1/22 381/345
6,208,237 B1 * 3/2001 Saiki ..... H04M 1/03 340/388.1
9,906,867 B2 * 2/2018 Bongiovi ..... H04R 9/043
2005/0269899 A1 * 12/2005 Matsuzawa ..... B06B 1/0292 310/311
2014/0355388 A1 * 12/2014 Kent ..... H04B 11/00 367/140
2015/0078592 A1 * 3/2015 Uchida ..... H04R 19/04 381/191
2015/0078593 A1 * 3/2015 Uchida ..... H04R 19/005 381/191
2015/0110309 A1 * 4/2015 Park ..... H04R 19/005 381/190
2015/0230027 A1 * 8/2015 Inoue ..... H04R 19/00 381/191

(Continued)

*Primary Examiner* — Jason C Olson

(57) ABSTRACT

An acoustic resonator device for reproducing sound in audio headphones having acoustic transducers coupled to resonating structures composed of various materials which react to the vibrations of the transducers. The resonator structures are designed with large surface areas by using projections of rigid materials of various shapes, sizes and quantities. These projections also resonate at different frequencies. The acoustic resonator reproduces sound from audio sources without compression waves being directed into the ear. These compression waves emanate from more typical audio drivers found in most headphones and can lead to listening fatigue as well as discomfort. The acoustic resonator device also produces a haptic effect which produces a richer sound, especially in the low frequency range. More than one acoustic transducer and resonator assembly is used to reduce distortion by dividing the frequency response into low and high/mid frequency ranges.

19 Claims, 5 Drawing Sheets

(56) References Cited

U.S. PATENT DOCUMENTS

2017/0116973 A1* 4/2017 Ohnishi ..... G10H 3/146

* cited by examiner

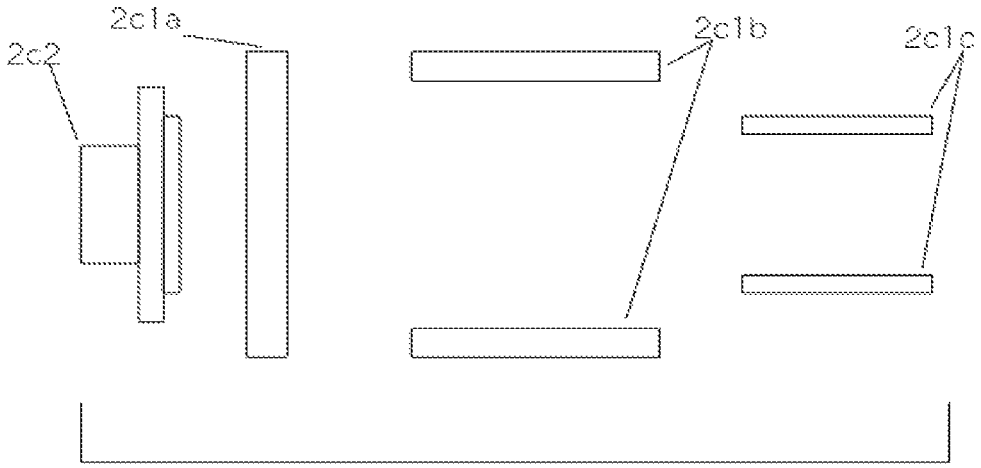
Fig. 7
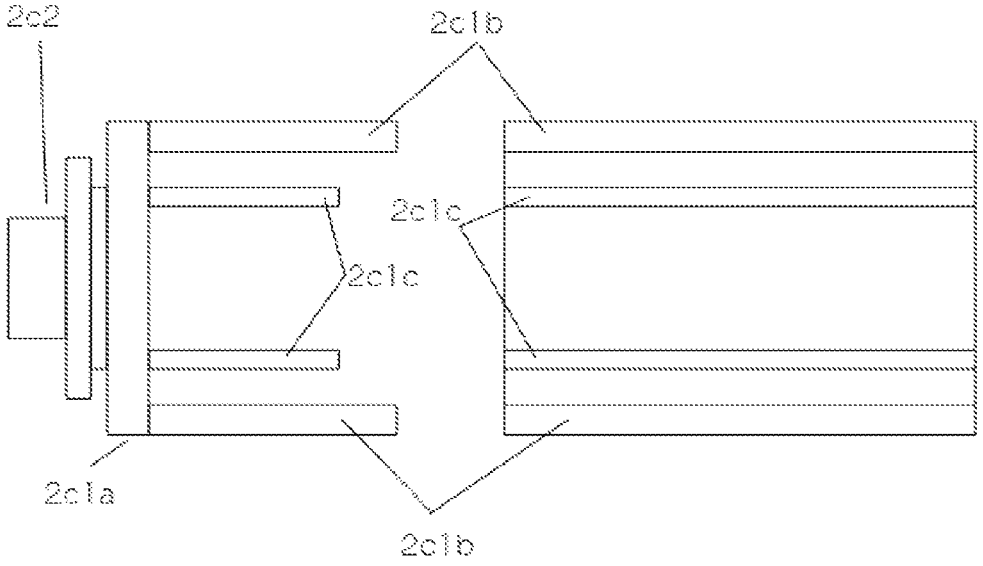
Fig. 8
Fig. 9

ACOUSTIC RESONATOR FOR AUDIO HEADPHONES

BACKGROUND

Field of Invention

This invention relates to the design of sound reproduction elements in audio headphones.

Description of Prior Art

Audio headphones are typically designed with diaphragm elements of a compression driver design. These elements produce sound like conventional speakers which generate compression waves from a mechanical diaphragm driven by an electrical signal from an amplifier. Typically, the diaphragm elements are arranged inside the headphone housing so that compression waves are directed straight to the ear. U.S. Pat. No. 7,162,051 to Grell, et al (2007) discloses a headphone design in which the transducer is mounted so that the compression waves are directed into the ear. This arrangement can cause listening fatigue as well as hearing loss from high sound levels.

Most headphones are designed with one diaphragm element which is expected to reproduce the frequencies within the range of human hearing. This is often stated to be between 20-20,000 hertz. These diaphragm elements often cannot accurately reproduce the entire range without some distortion occurring. U.S. Pat. No. 4,418,248 to Mathis (1983) discloses a dual transducer design which divides the audio spectrum between the two transducers. The transducers are also mounted to direct the compression waves into the ear, putting stress on the ear drum.

The haptic effect as it applies to sound reproduction is the physical sensation of sound as well as the hearing of sound. Audiences of live concerts with higher volume levels often experience this "felt" sound, particularly from lower frequencies such as a bass drum beat. This effect is not reproduced very well in conventional headphone design due to the typical low mass of the diaphragm elements. U.S. Pat. No. 8,767,996 to Lin, et al (2014) discloses a headphone design incorporating a haptic transducer in the head band and in the ear pad housings in another drawing. The haptic transducers are not shown to be connected to a resonator assembly and are directed into the ear from the ear pad housings.

Objectives and Advantages

A. To use acoustic resonance to reproduce sound. No compression diaphragm type driver is employed in the design. This design can reduce listening fatigue.

B. To provide a haptic effect especially in lower frequencies. This produces a fuller, richer sound.

C. To provide for a variety of configurations that enable the acoustic resonator to be tuned for different listening preferences.

D. To provide for lower distortion by incorporating more than one audio transducer element into the acoustic resonator.

DRAWING FIGURES

FIG. 7 is an exploded diagram of the high/mid frequency resonator, all of which comprises the embodiment of the invention.

FIG. 8 is a side view of the high/mid frequency resonator which comprises the embodiment of the invention.

FIG. 9 is a front view of the high/mid frequency resonator which comprises the embodiment of the invention.

SUMMARY

In accordance with the present invention, an acoustic resonator design incorporated into a stereophonic headphone set, producing a haptic effect, and to reduce listening fatigue and distortion.

REFERENCE NUMBERS IN DRAWINGS

1 Head pad
2 Housing assembly
3 Hanger screw
4 Ear pad
5 Hanger
2*a* Housing
2*b* Spacers, medium size
2*c* High/Mid frequency resonator assembly
2*c*1 High/Mid frequency resonator
2*c*1*a* Rigid flat plate-high/mid frequency resonator
2*c*1*b* Rigid projections, medium size-high/mid frequency resonator
2*c*1*c* Rigid projections, small size-high/mid frequency resonator
2*c*2 Second acoustic transducer
2*d* Low frequency acoustic resonator assembly
2*d*1 Rigid flat plate with rigid projections-low frequency resonator
2*d*2 Rigid spacer-low frequency resonator
2*d*3 Spacer-high/mid frequency resonator assembly
2*d*4 Second rigid flat plate-low frequency resonator
2*d*5 Mechanical fastener holes
2*d*6 Mechanical fastener-high/mid frequency resonator assembly
2*d*7 Rigid projections, medium size-low frequency resonator
2*d*8 Mounting plate for acoustic transducer
2*d*9 Rigid projections, small size-low frequency resonator
2*d*10 Rigid projections, large size-low frequency resonator
2*d*11 Mounting hole for acoustic transducer
2*e* Acoustic transducer
2*f* Mechanical fastener-low frequency resonator Description of FIGS. 1-9

Figure 1:
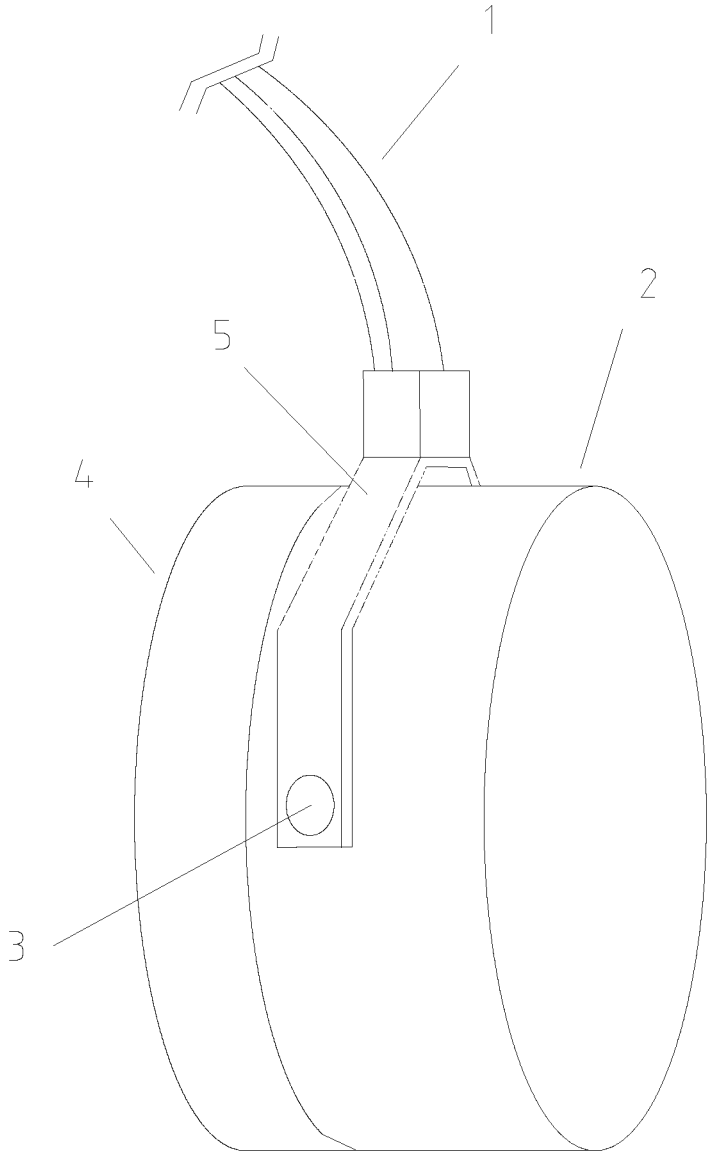
FIG. 1 shows the invention incorporated into a typical headphone set for stereophonic music listening. The figure shows one half (one stereo channel) of a two stereo channel headphone set.

The drawing in FIG. 1 shows one half of a typical two channel stereophonic headphone assembly comprising a head pad 1, a housing assembly 2, which contains the sound reproducing elements, a hanger 5, for supporting the housing assembly 2, a hanger screw 3 (1 of 2) for mounting the housing assembly 2 to hanger 5, and an ear pad 4, which provides a cushion for the ear and head.

Figure 2:
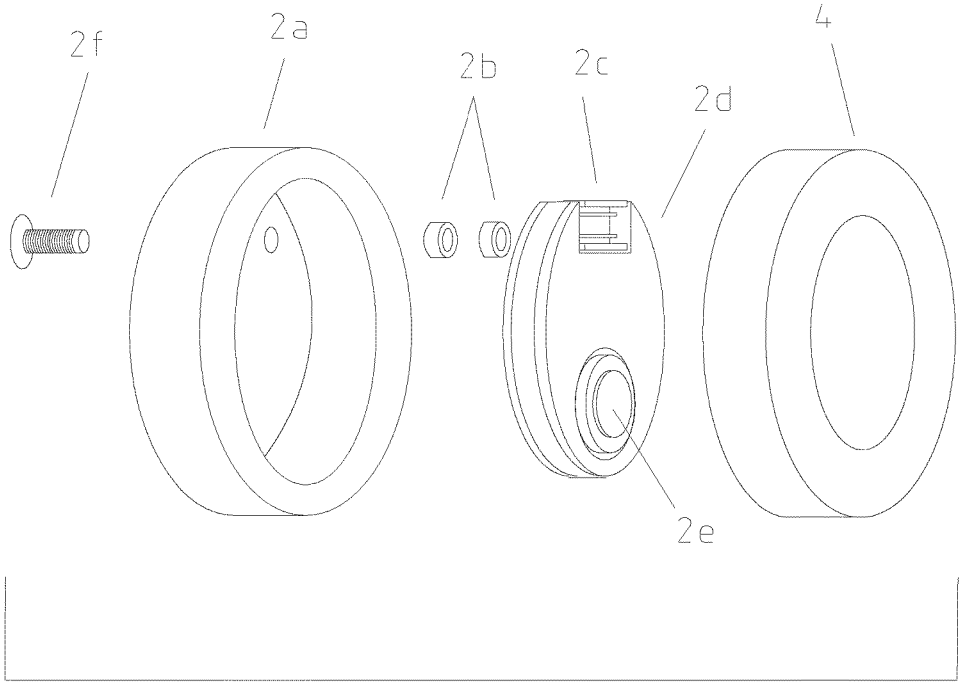
FIG. 2 is an exploded diagram of the housing assembly which contains the acoustic resonator assembly, all of which comprises the embodiment of the invention.

The drawing in FIG. 2 is an exploded diagram showing the major components of the housing assembly 2. A typical embodiment of the present invention is illustrated by the housing 2*a*, the spacers 2*b*, the mechanical fastener 2*f* (1 of 2), the high/mid frequency resonator assembly 2*c*, the low frequency resonator assembly 2*d* and 2*e*. The ear pad 4 is not part of the embodiment of the present invention.

The housing 2*a*, is made of any high density material that has good acoustic qualities. These would include, but are not limited to wood, plastic, and metal. The housing 2*a* has a cavity that is closed on one side. The cavity is larger in area than the low frequency resonator assembly 2*d*.

The spacers 2*b* are made of a medium density rubber or plastic material and separate the low frequency resonator assembly 2*d* and 2*e* from the housing 2*a*. The mechanical fastener 2*f* (1 of 2) is inserted through the closed side of housing 2*a*, the spacers 2*b* and into the low frequency resonator assembly 2*d* and 2*e* to the housing 2*a*. An ear pad 4 is attached to the housing 2*a* by mechanical or adhesive means. The ear pad 4 and the means to attach it to the housing 2*a* are not part of the embodiment of the present invention.

Figure 3:
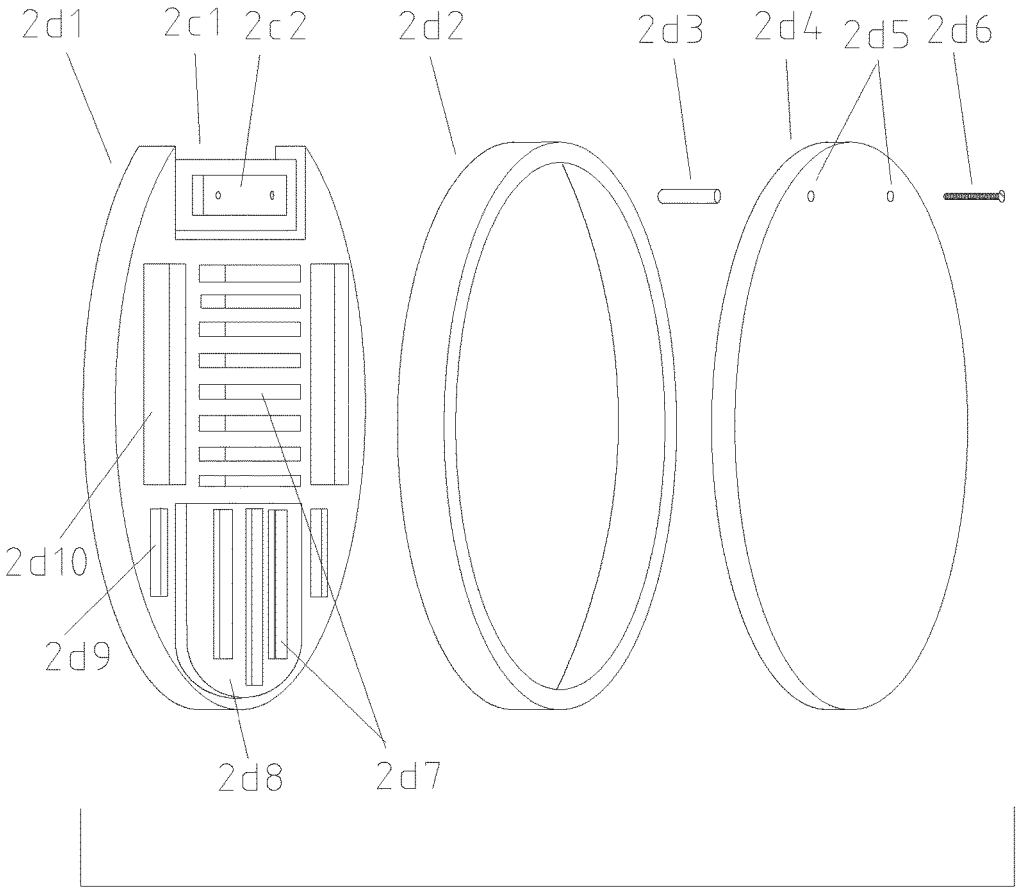
FIG. 3 is an exploded diagram of the acoustic resonator assembly, all of which comprises the embodiment of the invention.

The drawing in FIG. 3 is an exploded diagram of the low frequency resonator assembly 2*d*. The rigid flat plate 2*d*1 is made of a high density material of uniform thickness such as, but not limited to, wood, plastic, or metal, and can be any size, number, or shape, to which are attached or machined into the rigid flat plate, the various sizes of resonator projections. The small size rigid projections 2*d*9, the medium size rigid projections 2*d*7, and the large size rigid projections 2*d*10 are made of a high density material such as, but not limited to, hardwood, plastic, or metal and resonate at different frequencies within the range of 20 Hz to 1200 Hz. The rigid projections can be arranged in any number, size, shape and pattern to achieve the desired acoustic quality. The rigid projections also provide an increase in the surface area of the acoustic resonator 2*d* providing good bass response from a practical headphone size. The mounting plate 2*d*8 holds an acoustic transducer which is attached with an adhesive or mechanical means to the opposite side of the rigid flat plate with the rigid projections 2*d*1. The rigid spacer 2*d*2 is made of a high density material to provide a gap between the rigid projections of 2*d*1 and the second rigid flat plate 2*d*4. The high/mid frequency resonator 2*c*1 and second acoustic transducer 2*c*2 form an assembly which is attached to the closed side of housing 2*a* with at least two mechanical fasteners 2*d*6 and at least two spacers 2*d*3 through holes 2*d*5. The high/mid frequency resonator 2*c*1 and the second acoustic transducer 2*c*2 are centered within a notch in the edge of the low frequency resonator assembly 2*d* and 2*e* with no contact with said low frequency resonator assembly 2*d* and 2*e*.

Figure 4:
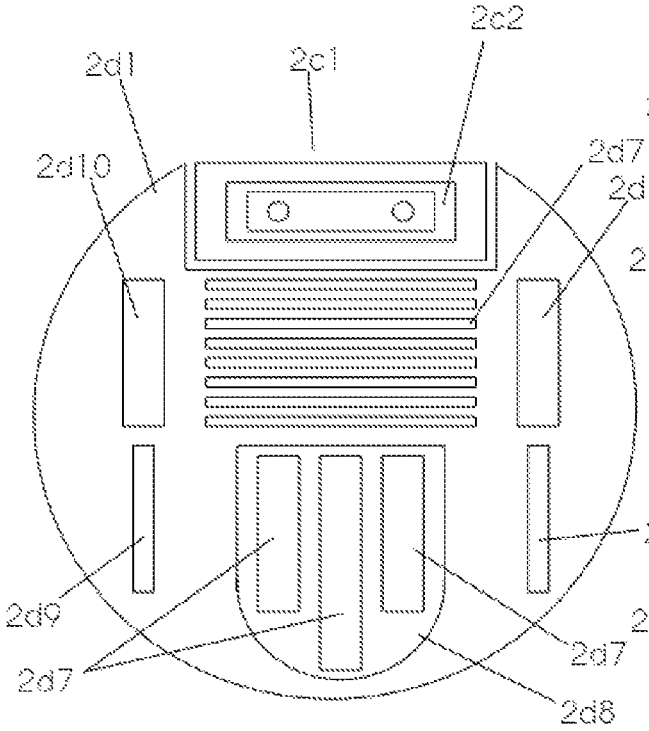
FIG. 4 is a front view of the acoustic resonator assembly showing the positions of the low frequency resonator, the high/mid frequency resonator, and the transducers in relation to each other, all of which comprises the embodiment of the invention.

The drawing in FIG. 4 shows a front view of the rigid flat plate with rigid projections comprising the low frequency resonator 2*d*1 along with the position of the high/mid frequency resonator 2*c*1 and the second acoustic transducer 2*c*2, with respect to 2*d*1.

Figure 5:
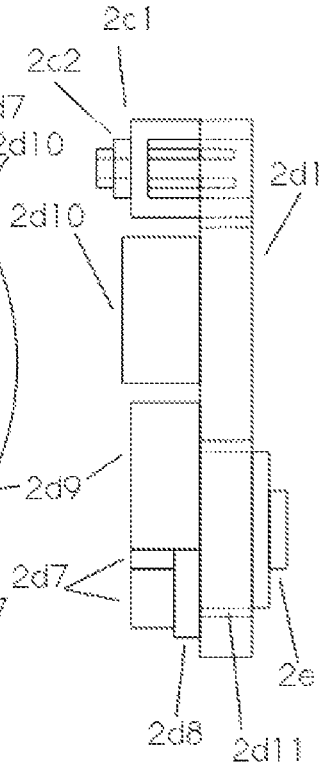
FIG. 5 is a side view of the acoustic resonator assembly showing the positions of the low frequency resonator, the high/mid frequency resonator, and the transducers in relation to each other, all of which comprises the embodiment of the invention.
Figure 6:
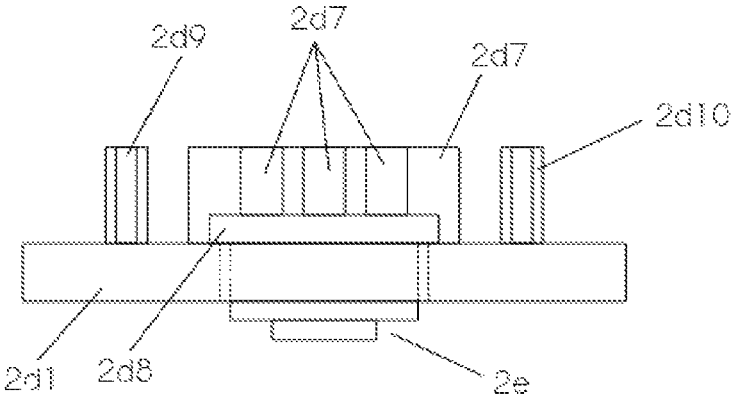
FIG. 6 is another side view of the acoustic resonator assembly showing the positions of the low frequency resonator and a transducer, all of which comprises the embodiment of the invention.

FIG. 5 is a side view showing an acoustic transducer 2*e* positioned in mounting hole 2*d*11 and attached to mounting plate 2*d*8. FIG. 6 is another side view of the low frequency resonator rigid flat plate with rigid projections and acoustic transducer 2*e*.

FIG. 7 is an exploded view of the high/mid frequency resonator 2*c*1 and an acoustic transducer 2*c*2.

FIG. 8 is a side view of the high/mid frequency resonator 2*c*1. A second acoustic transducer 2*c*2 is attached to the closed side of the housing 2*a* with an adhesive or mechanical fastener. At least one large rigid projection 2*c*1*b* and at least one small rigid projection 2*c*1*c* are fastened to the back plate 2*c*1*a* with an adhesive or mechanical means as shown in side view FIG. 8.

FIG. 9 is a front view of the high/mid frequency resonator 2*c*1. The rigid flat plate 2*c*1*a* and the rigid projections 2*c*1*b* and 2*c*1*c* resonate within approximately 1200 Hz to 20,000 Hz and provide a surface area large enough for a more balanced high/mid frequency response with the bass response. The rigid flat plate 2*c*1*a*, and the rigid projections 2*c*1*b* and 2*c*1*c* are made of a rigid low density material such as, but not limited to, a softwood species or plastic, or a light weight metal, and has a uniform thickness.

Operation

An electrical signal from an amplified source such as as a stereophonic audio amplifier, portable audio device, or smart phone, is sent through a conductive wire to the acoustic transducers. A crossover circuit that divides the signal into the low frequencies from approximately 20 Hz to 1200 Hz and the high/mid frequencies from approximately 1200 Hz to 20,000 Hz. This would provide an enhanced low distortion sound output. The crossover circuit can be located internally or externally of the headphone housing 2. The crossover circuit components can be varied to produce different frequency crossover points. The crossover circuit is not part of the embodiment of the present invention. The amplifier signal is then passed onto the acoustic transducers 2*c*2 and 2*e*.

The acoustic transducer 2*e* causes the low frequency resonator assembly 2*d* to react within the low frequency range of approximately 20 Hz to 1200 Hz and the second acoustic transducer 2*c*2 causes the resonator assembly 2*c* to react within the high/mid frequency range of approximately 1200 Hz to 20,000 Hz.

The small, medium, and large rigid projections resonate at different frequencies and also increase the surface area of the acoustic resonators to enhance the overall acoustic response. The enhanced response of the low frequency acoustic resonator also provides a haptic effect especially in the lower frequencies of approximately 20 Hz to 1200 Hz.

I claim:

1. An acoustic resonating device for reducing sound distortion, decreasing listening fatigue, and creating a haptic effect, comprising:

a housing;

a first rigid flat plate and a second rigid flat plate spaced apart by a rigid spacer, wherein said rigid spacer comprises a shape and a circumference approximately equivalent to a shape and circumference of said first rigid flat plate and said second rigid flat plate;

said first rigid plate comprises a low frequency resonator assembly and a mid/high frequency resonator assembly, wherein said low frequency resonator assembly comprise a first set of rigid projections of a first size, and said mid/high frequency resonator assembly comprises a second set of rigid projections of a second size and a third set of rigid projections of a third size, wherein the size of said first set of rigid projections is greater than the size of said second set of rigid projections, and the size of said third set of rigid projections is smaller than the size of said second set of rigid projections; and said first rigid plate further comprises a first acoustic transducer resonator and a second acoustic transducer resonator, wherein said first acoustic transducer resonator resonates said low frequency resonator assembly at a first frequency range, thereby creating a haptic effect, and said second acoustic transducer resonator resonates said mid/high frequency resonator assembly at a second frequency range.

2. The acoustic resonating device of claim 1, wherein said first rigid flat plate and said second rigid flat plate are composed of a high density material of uniform thickness.

3. The acoustic resonating device of claim 2, wherein said rigid projections of said first set, second set, and third set, are attached or machined into the surface of said first rigid flat plate.

4. The acoustic resonating device of claim 3, wherein said rigid projections project outward in the direction of said rigid spacer.

5. The acoustic resonating device of claim 2, wherein said first rigid flat plate is attached to a first side of said rigid spacer and said second rigid flat plate is attached to a second side of said rigid spacer, opposite the first side, forming a sandwich assembly.

6. The acoustic resonating device of claim 5, wherein at least one notch of a predetermined size and shape is formed into an outer edge of said sandwiched assembly.

7. The acoustic resonating device of claim 6, wherein said housing is composed of a high density material.

8. The acoustic resonating device of claim 7, where said housing has an internal cavity larger than said sandwiched assembly.

9. The acoustic resonating device of claim 8 wherein said housing has one closed side.

10. The acoustic resonating device of claim 9 wherein said closed side comprises at least one hole.

11. The acoustic resonating device of claim 10 wherein at least one mechanical fastener is inserted into said at least one hole.

12. The acoustic resonating device of claim 11 wherein at least one spacer is placed onto said mechanical fastener.

13. The acoustic resonating device of claim 12, where said sandwiched assembly of is inserted into said internal cavity such that said sandwiched assembly is centered within said internal cavity.

14. The acoustic resonating device of claim 13, wherein said mechanical fastener is inserted into said sandwiched assembly such that said sandwiched assembly is mounted on said spacer.

15. The acoustic resonating device of claim 14, wherein said closed side further comprises at least one additional hole.

16. The acoustic resonating device of claim 15, wherein at least one additional mechanical fastener is inserted into said at least one additional hole.

17. The acoustic resonating device of claim 16 wherein at least one additional spacer is placed onto said at least one additional mechanical fastener.

18. The acoustic resonating device of claim 17, wherein said second acoustic transducer is attached such that said at least one additional mechanical fastener is inserted into said second acoustic transducer such that said second acoustic transducer is mounted on said at least one additional spacer, wherein said second acoustic transducer is centered within said notch.

19. The acoustic resonating device of claim 18, further comprising at least one additional rigid flat plate attached to said second acoustic transducer such that said at least one additional rigid flat plate is centered within said notch.

* * * * *